US006817038B2

(12) United States Patent
Blanco

(10) Patent No.: US 6,817,038 B2
(45) Date of Patent: Nov. 16, 2004

(54) REVERSIBLE THONG-TYPE UNDERGARMENT

(75) Inventor: Robert M. Blanco, West Long Branch, NJ (US)

(73) Assignee: BB Originals Ltd., New York, NY (US)

( * ) Notice: Subject to any disclaimer, the term of this patent is extended or adjusted under 35 U.S.C. 154(b) by 119 days.

(21) Appl. No.: 10/137,465

(22) Filed: May 1, 2002

(65) Prior Publication Data

US 2003/0204898 A1 Nov. 6, 2003

(51) Int. Cl.[7] ..... A41B 9/04
(52) U.S. Cl. ..... 2/406; 2/67
(58) Field of Search ..... 2/400, 401, 403, 2/406, 408, 46, 67, 69, 78.1–78.4, 243.1, DIG. 2; 602/60, 61, 67, 69, 70; 450/99, 100, 107, 151, 153, 156; D2/700, 711, 712, 713, 714, 731, 738

(56) References Cited

U.S. PATENT DOCUMENTS 2,085,425 A * 6/1937 Goodwin ..... 2/67
2,401,457 A * 6/1946 Bryant ..... 2/406
4,121,305 A * 10/1978 Kolker ..... 2/406
4,414,691 A * 11/1983 Estruch ..... 2/67
4,481,683 A * 11/1984 Estruch ..... 2/400
5,528,775 A * 6/1996 Marenda ..... 2/406
6,067,663 A * 5/2000 Fernandez ..... 2/406

OTHER PUBLICATIONS

Victoria's Secret—Designer Lingerie—Spring/Summer 1984; p. 13, inset; p. 15, inset; p. 19(c) Bikini.*

* cited by examiner

*Primary Examiner*—Gloria M. Hale
(74) *Attorney, Agent, or Firm*—Waton & Kipnes, P.C.

(57) ABSTRACT

A reversible thong-type undergarment which includes a single unseamed cloth having opposed first and second panels secured thereto wherein each of the panels may have different color combinations and/or designs. The thong-type undergarment may be easily secured to the body of the person without having to tie strings together or engage in other such activities.

10 Claims, 3 Drawing Sheets

REVERSIBLE THONG-TYPE UNDERGARMENT

FIELD OF THE INVENTION

The present invention is directed to the reversible thong-type undergarment which may be worn to reveal different patterns or the like on opposed sides of the undergarment in which the patterned opposed sides are secured to a substrate through the use of a binding assembly which enables the garment to be placed about the body without the tying of strings and the like.

BACKGROUND OF THE INVENTION

Thong-type undergarments have become popular in recent years for a variety of reasons including an attractive, sleek look, minimum storage space and the like. More recently such thong-type undergarments have been provided with an outside surface revealing an attractive design which can employ bright colors, intricate patterns, and even direct or indirect messages such as a heart (e.g. for Valentine's Day).

It would be an advantage in the art of producing thong-type undergarments to provide a reversible garment that would permit, preferably, two different designs to be employed on a single undergarment which would have obvious consumer appeal.

Known in the art is a reversible bathing garment as depicted in Estruch, U.S. Pat. No. 4,414,691 which provides for a bottom portion formed from a single cloth made from a single piece of material which may have the same or different colors or different combinations of colors on each side. The cloth is bound with elastic binding tapes which are extended so that they may be tied together to enable the bottom portion of the bathing suit to be secured about the waste of the user.

SUMMARY OF THE INVENTION

The present invention is generally directed to a reversible thong-type undergarment in which the garment is readily reversible by inverting the main portion of the undergarment prior to use. The garment is readily worn about the body of the user without having to tie strings or the like.

In a particular aspect of the present invention, there is provided a reversible thong-type undergarment which comprises:

a) a single unseamed cloth having first and second opposed surfaces and a peripheral edge;

b) a first panel of material secured to one of said first or second opposed surfaces;

c) a second panel of material secured to the other of the first or second opposed surfaces; and d) a binding assembly for securing the first and second panels of material to the single unseamed cloth about said peripheral edge and including means for supporting the undergarment about the body of a person.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is generally directed to a reversible thong-type undergarment which is constructed to allow not only reversibility but enables the user to place the same about the body in either reversible position. As used herein the term "thong-type undergarment" includes thongs, bikinis, g-strips and brief type undergarments and the like.

Figure 1:
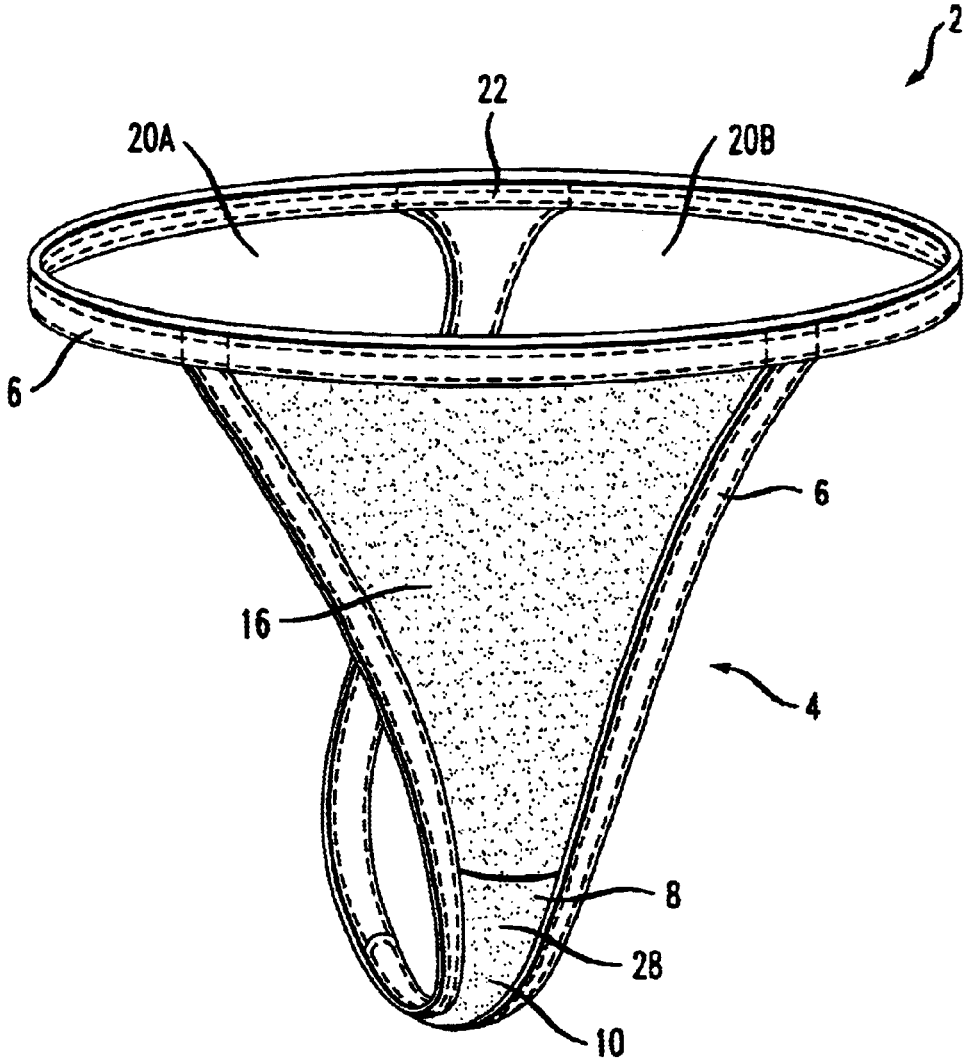
FIG. 1 is a front view of one embodiment of a reversible thong-type undergarment of the present invention.
Figure 2:
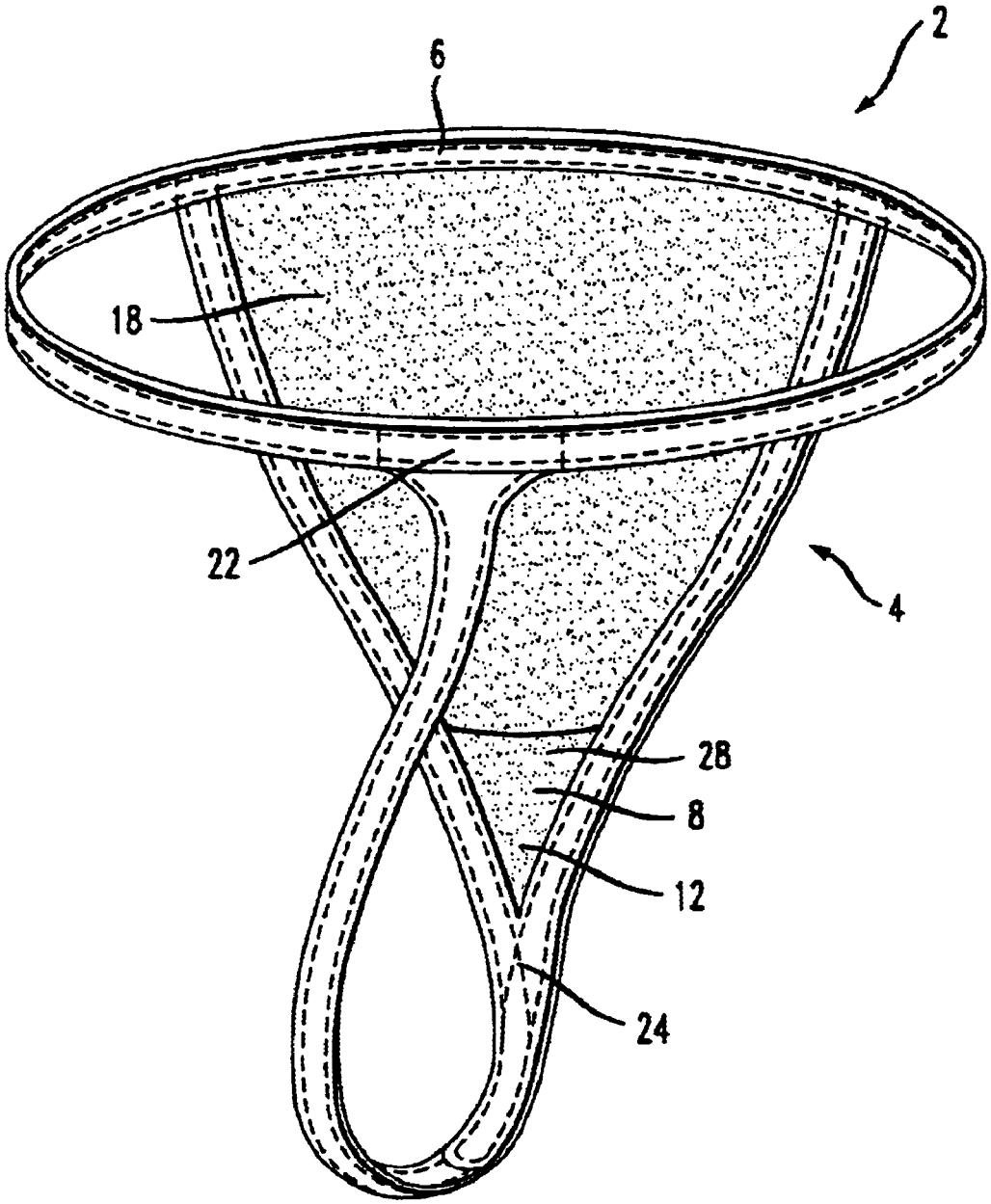
FIG. 2 is a rear view of the embodiment of the invention shown in FIG. 1.

Referring to the drawings and particularly to FIGS. 1 and 2 there is shown a thong-type undergarment 2 having a main body portion 4 and a binding assembly 6 for securing the thong-type undergarment 2 about the body of a person.

The main body portion 4 is comprised of a single cloth 8 having a front side 10 shown in FIG. 1 and a rear side 12 shown in FIG. 2. The single cloth 8 has a peripheral edge bound by a binding assembly 6 which is preferably an elastic band but may be selected from other types of materials.

Secured to the single cloth 8 via the binding assembly 6 is a first or front panel 16 shown in FIG. 1 and a second or rear panel 18 shown in FIG. 2. The respective front and rear panels may be made from the same or different materials typically selected from materials suitable for undergarments such as cotton, knitted fabrics, and the like. It will be understood that the front and rear panels may be continuous as shown or may have openings therein (e.g. design cutouts such as circles). The front and rear panels may be provided with the same colors and/or designs or different colors and/or designs. The front and rear panels when employed with different colors and/or designs provide a different appearance of the thong-type undergarment when the undergarment is reversed wherein the front panel becomes the rear panel and thereby becomes hidden from view and the rear panel becomes the front panel and thereby viewable when the undergarment is worn. As shown specifically in FIGS. 1 and 2, the front and rear panels 16 and 18 do not cover the entire surface area of the cloth but instead leave an unpaneled portion designated by the numeral 28.

The binding assembly 6, typically in the form of an elastic band, is extended past the peripheral edge of the main body portion 4 to form a pair of loops 20A and 20B through which the user inserts their legs when placing the undergarment about the body. The loops 20A and 20B are closed at a first junction 22 where the extension continues to connect to the main body portion 4 at a second junction 24. All or a portion of the binding assembly may be provided with different colors, designs, embroidered patterns and the like to contribute to the overall appearance of the undergarment.

In accordance with the present invention, the thong-type undergarment may be placed about the body by inserting the legs within the loops 20A and 20B with the front panel 16 facing outwardly and the rear panel 18 facing inwardly. The undergarment may be reversed by lifting the main body portion 4 until the previous front panel 16 faces inwardly and the rear panel 18 faces outwardly. The reversibility of the undergarment can be accomplished without having to tie strings or make any other connections to facilitate the process of reversibility. In addition, the front and rear panels can be provided with different designs and/or different color combinations to provide essentially two different looking undergarments within the same undergarment.

Figure 3:
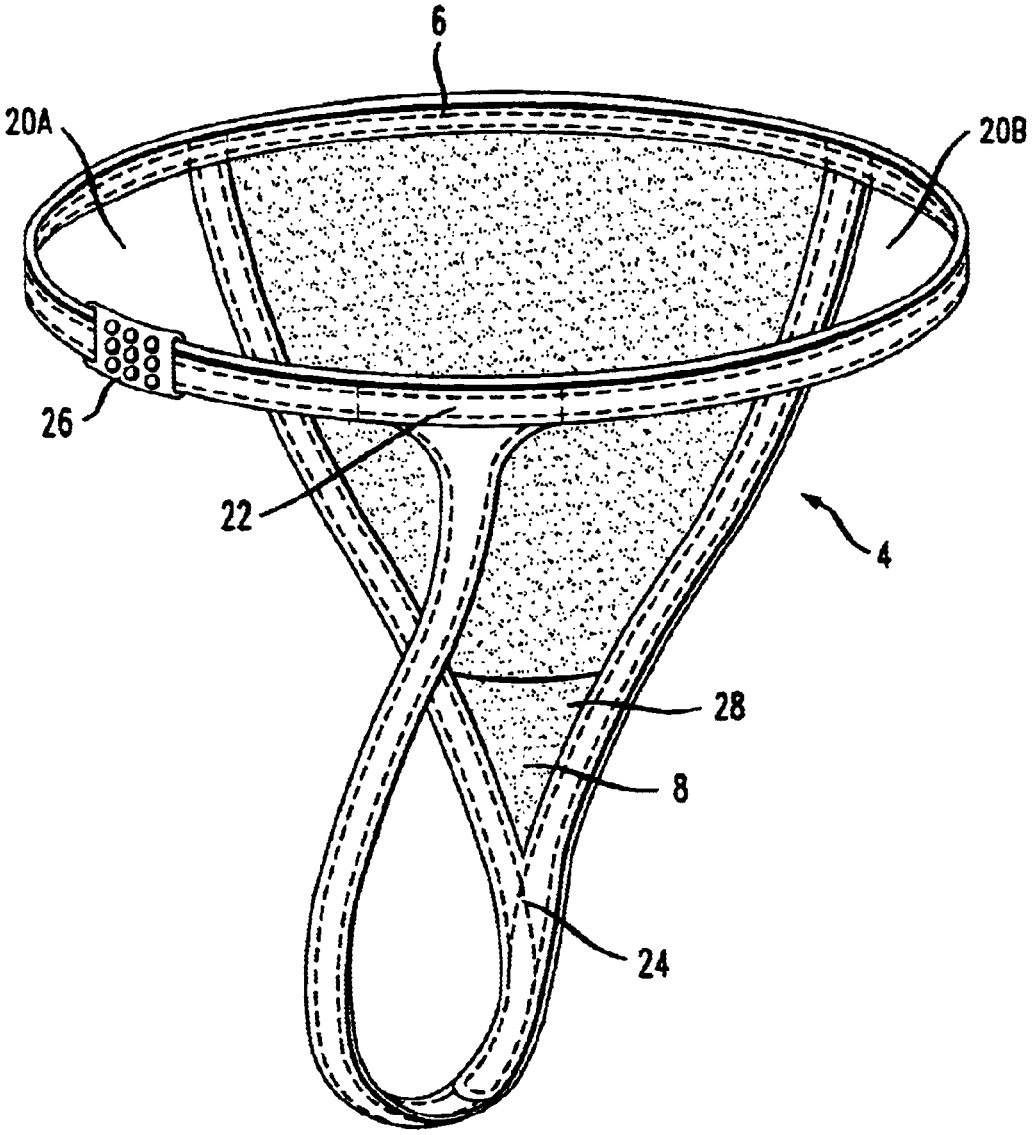
FIG. 3 is a front view of a further embodiment of the invention wherein the extension of the binding assembly includes a connecting assembly.

In a further embodiment of the invention as shown in FIG. 3, the extended portion of the elastic band which is used to form the loops 20A and 20B and/or the extension from junction 22 to junction 24 to complete the thong-type structure may include decorative devices such as a connecting assembly 26 such as interlocking rings made of metal, plastic or other types of materials. More than one such assembly 26 may be provided along the binding assembly including between junctions 22 and 24.

Other embodiments of the present invention would become apparent to those of ordinary skill in this art and are included within the scope of the present application.

What is claimed is:

1. A reversible thong-type undergarment which comprises:

a) a single unseamed cloth having first and second opposed surfaces and a peripheral edge;

b) a first panel of material secured to one of said first or second opposed surfaces;

c) a second panel of material secured to the other of the first or second opposed surfaces; and d) a binding assembly for securing the first and second panels of material to the single unseamed cloth about said peripheral edge and including means for supporting the undergarment about the body of a person comprising an extension of the binding assembly in the form or a pair of opposed loops.

2. The reversible thong-type undergarment of claim 1 wherein the first and second panels are comprised of the same material.

3. The reversible thong-type undergarment of claim 1 wherein the first and second panels are comprised of different materials.

4. The reversible thong-type undergarment of claim 1 wherein the first and second panels are identical in appearance.

5. The reversible thong-type undergarment of claim 1 wherein the first and second panels have a different appearance.

6. The reversible thong-type undergarment of claim 1 wherein the binding assembly is an elastic band.

7. The reversible thong-type undergarment of claim 1 wherein at least one of the first and second panels do not cover the entire opposed surface of the single unseamed cloth.

8. The reversible thong-type undergarment of claim 1 wherein the extension of the binding assembly includes at least two different materials, one of said materials being an elastic band.

9. The reversible thong-type undergarment of claim 8 wherein one of said materials is a connecting assembly.

10. The reversible thong-type undergarment of claim 9 wherein the connecting assembly is comprised of interlocking rings.

* * * * *